US007899603B2

(12) United States Patent
Yamamoto et al.

(10) Patent No.: US 7,899,603 B2
(45) Date of Patent: Mar. 1, 2011

(54) FUEL INJECTION CONTROLLER

(75) Inventors: Takenobu Yamamoto, Kariya (JP); Takayoshi Inaba, Kariya (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 12/485,418

(22) Filed: Jun. 16, 2009

(65) Prior Publication Data

US 2010/0017100 A1 Jan. 21, 2010

(30) Foreign Application Priority Data

Jul. 15, 2008 (JP) ..... 2008-183690

(51) Int. Cl.
*F02D 41/30* (2006.01)

(52) U.S. Cl. ..... 701/104; 701/114; 123/299; 123/435

(58) Field of Classification Search ..... 701/101–105, 701/108, 114, 115; 123/435, 299, 486, 674
See application file for complete search history.

(56) References Cited

U.S. PATENT DOCUMENTS

| | | | | |
|---|---|---|---|---|
| 5,668,726 | A * | 9/1997 | Kondo et al. | 701/115 |
| 6,543,422 | B2 * | 4/2003 | Minowa et al. | 123/478 |
| 6,755,176 | B2 | 6/2004 | Takeuchi et al. | |
| 6,792,346 | B2 * | 9/2004 | Takebayashi et al. | 701/113 |
| 6,904,354 | B2 * | 6/2005 | Kuegel et al. | 701/104 |
| 6,975,933 | B2 * | 12/2005 | Abe et al. | 701/109 |
| 6,988,030 | B2 | 1/2006 | Asano et al. | |
| 2002/0099492 | A1 * | 7/2002 | Okawa et al. | 701/104 |
| 2003/0150428 | A1 * | 8/2003 | Hozuki | 123/486 |
| 2004/0158387 | A1 * | 8/2004 | Yasui et al. | 701/108 |
| 2004/0267433 | A1 | 12/2004 | Asano et al. | |

FOREIGN PATENT DOCUMENTS

| | | |
|---|---|---|
| JP | 11-36964 | 2/1999 |
| JP | 2008-101625 | 5/2008 |

OTHER PUBLICATIONS

Japanese Office Action dated Apr. 27, 2010, issued in corresponding Japanese Application No. 2008-183690, with English translation.

* cited by examiner

*Primary Examiner*—Stephen K Cronin
*Assistant Examiner*—Johnny H Hoang
(74) *Attorney, Agent, or Firm*—Nixon & Vanderhye P.C.

(57) ABSTRACT

In a fuel injection controller for a fuel injection system that executes an injection quantity learning operation for a fuel injection valve, a drive signal is outputted when the diagnosis condition is satisfied. An actual injection quantity of fuel that is actually injected by the fuel injection valve is computed. The fuel injection controller computes a correction amount based on a difference between the actual injection quantity and the command injection quantity. The fuel injection controller determines whether the correction amount exceeds a limit value. An injection deviation amount between the command injection quantity and the actual injection quantity of fuel, which is injected based on the drive signal corrected by the limit value, is computed when the correction amount exceeds the limit value.

7 Claims, 7 Drawing Sheets

FIG. 7A

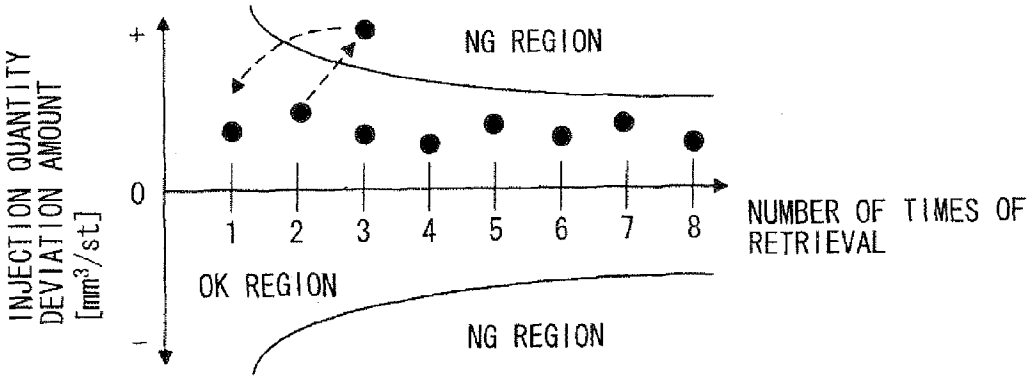

FIG. 7B

| RESULT OF TEMPORARY DIAGNOSIS | PULSE WIDTH CORRECTION AMOUNT | CORRECTION DIRECTION IN FCCB | MAIN DIAGNOSIS | DIAGNOSIS MODE | DIAGNOSIS CODE |
|---|---|---|---|---|---|
| DEVIATION AMOUNTS ARE IN OK REGION BY PREDETERMINED NUMBER OF TIMES | WITHIN LIMIT VALUE | SAME | — | COMPLETION OF DIAGNOSIS | 3 |
| | | DIFFERENT | PROHIBITION | ABNORMALITY IN MUTUAL SUPERVISORY | 5 |
| | BEYOND LIMIT VALUE | SAME | EXECUTION | EXECUTION OF MAIN DIAGNOSIS | 2 |
| | | DIFFERENT | PROHIBITION | ABNORMALITY IN MUTUAL SUPERVISORY | 5 |
| DEVIATION AMOUNTS ARE NOT IN OK REGION BY PREDETERMINED NUMBER OF TIMES | WITHIN LIMIT VALUE | — | PROHIBITION | DIVERGENCE | 4 |
| | BEYOND LIMIT VALUE | — | EXECUTION | EXECUTION OF MAIN DIAGNOSIS | 2 |

FUEL INJECTION CONTROLLER

CROSS REFERENCE TO RELATED APPLICATION

This application is based on and incorporates herein by reference Japanese Patent Application No. 2008-183690 filed on Jul. 15, 2008.

BACKGROUND OF THE INVENTION

1. Field of the Invention

The present invention relates to a fuel injection controller that diagnoses an injection quantity of a fuel injection valve that injects fuel to a cylinder of an internal combustion engine.

2. Description of Related Art

Recently, in order to meet the more strict emission control regulation, there has been a need for highly accurately control of an injection quantity of a fuel injection valve. For example, during one combustion cycle of a common-rail diesel engine, a pilot injection with a minute injection quantity is performed before a main injection that causes main torque for the engine. In the above case, the injection quantity is required to be highly accurately controlled Thus, mechanical improvement has been made in order to deal with machining error or age deterioration of the fuel injection valve.

However, because there is limitation in the mechanical improvement, as shown in JP-A-2005-36788 corresponding to US2004/0267433, the injection quantity is learned in order to correct the injection quantity such that the injection quantity of the fuel injection valve is highly accurately controlled. In the above injection quantity learning operation, a drive signal used for commanding the fuel injection valve to inject fuel is corrected by a correction amount that is determined based on a difference between a command injection quantity and an actual injection quantity. The command injection quantity is a target quantity of fuel required in the operation, and the actual injection quantity is an actual quantity, by which the fuel injection valve actually injects fuel.

For example, the injection quantity learning operation is executed when the internal combustion engine has been operated for a certain operational time period, or when the vehicle travels certain travel distance. If the learning operation is executed based on the above execution condition, sliding performance deterioration or wear of the fuel injection valve may develop more than expected before the next injection quantity learning operation is executed. As a result, the difference between the command injection quantity and the actual injection quantity may widely exceed a predetermined range finally. In other words, the above abnormality of the injection quantity will not be detected until the next injection quantity learning operation is executed. Thus, toxic substances in the exhaust gas may be emitted at a level beyond the legal limit disadvantageously.

Also, when the difference between the command injection quantity and the actual injection quantity becomes greater than the predetermined range, a correction amount, which is used for correcting the drive signal, and which is computed based on the difference between the command injection quantity and the actual injection quantity, may also exceed a correction limit value, accordingly. For example, when the correction amount is equal to or less than the correction limit value, it is possible to accurately correct the injection quantity based on the correction amount such that the actual injection quantity substantially becomes the command injection quantity. However, when the correction amount is greater than the correction limit value, it may not be assured that the injection quantity is accurately corrected based on the correction amount. Thus, when the correction amount goes beyond the correction limit value, it is difficult to highly accurately compute an uncorrectable deviation amount between the command injection quantity and the actual injection quantity based on the correction amount of the drive signal. In the above, the uncorrectable deviation amount corresponds to a deviation amount between (a) the command injection quantity and (b) the actual injection quantity made based on the drive signal that is corrected by the correction limit value serving as the correction amount.

SUMMARY OF THE INVENTION

The present invention is made in view of the above disadvantages. Thus, it is an objective of the present invention to address at least one of the above disadvantages.

To achieve the objective of the present invention, there is provided a fuel injection controller for a fuel injection system that executes an injection quantity learning operation for a fuel injection valve that injects fuel into a cylinder of an internal combustion engine. The fuel injection controller diagnoses an injection quantity of the fuel injection valve. In the fuel injection controller, it is determined whether a diagnosis condition for diagnosing the injection quantity of the fuel injection valve is satisfied. A drive signal is outputted in order to command the fuel injection valve to inject fuel of a command injection quantity used in order to diagnose the injection quantity when the diagnosis condition is satisfied. An actual injection quantity of fuel that is actually injected by the fuel injection valve, which is commanded to inject fuel in order to diagnose the injection quantity, is computed. A correction amount is computed based on a difference between the actual injection quantity and the command injection quantity, and the correction amount is used for correcting the drive signal. It is determined whether the correction amount exceeds a limit value. An injection deviation amount between the command injection quantity and the actual injection quantity of fuel, which is injected by the fuel injection valve based on the drive signal that is corrected by the limit value, is computed when the correction limit determination means determines that the correction amount exceeds the limit value.

To achieve the objective of the present invention, there is also provided a method for diagnosing an injection quantity of a fuel injection valve. In the method, it is determined whether a diagnosis condition for diagnosing the injection quantity of the fuel injection valve is satisfied. A drive signal that corresponds to a command injection quantity of fuel used in order to diagnose the injection quantity of the fuel injection valve is computed. The drive signal is corrected based on a first correction amount. The fuel injection valve is commanded to inject fuel based on the drive signal corrected by the first correction amount when the diagnosis condition is satisfied. A first actual injection quantity of fuel, which is actually injected by the fuel injection valve based on the drive signal corrected by the first correction amount, is computed. A second correction amount is computed based on a difference between the command injection quantity and the first actual injection quantity. It is determined whether the second correction amount exceeds a limit value. The fuel injection valve is commanded to inject fuel based on the drive signal corrected by the limit value when the second correction amount exceeds the limit value. A second actual injection quantity of fuel, which is actually injected by the fuel injection valve based on the drive signal corrected by the limited value, is computed. An injection deviation amount between the command injection quantity and the second actual injection quantity of fuel is computed.

BRIEF DESCRIPTION OF THE DRAWINGS

The invention, together with additional objectives, features and advantages thereof, will be best understood from the following description, the appended claims and the accompanying drawings in which:

FIG. 7A is an explanatory diagram illustrating a correction process of the injection quantity; and FIG. 7B is an explanatory diagram illustrating diagnostic result.

DETAILED DESCRIPTION OF PREFERRED EMBODIMENTS

One embodiment of the present invention will be described with accompanying drawings.

[Fuel Injection System]

Figure 1:
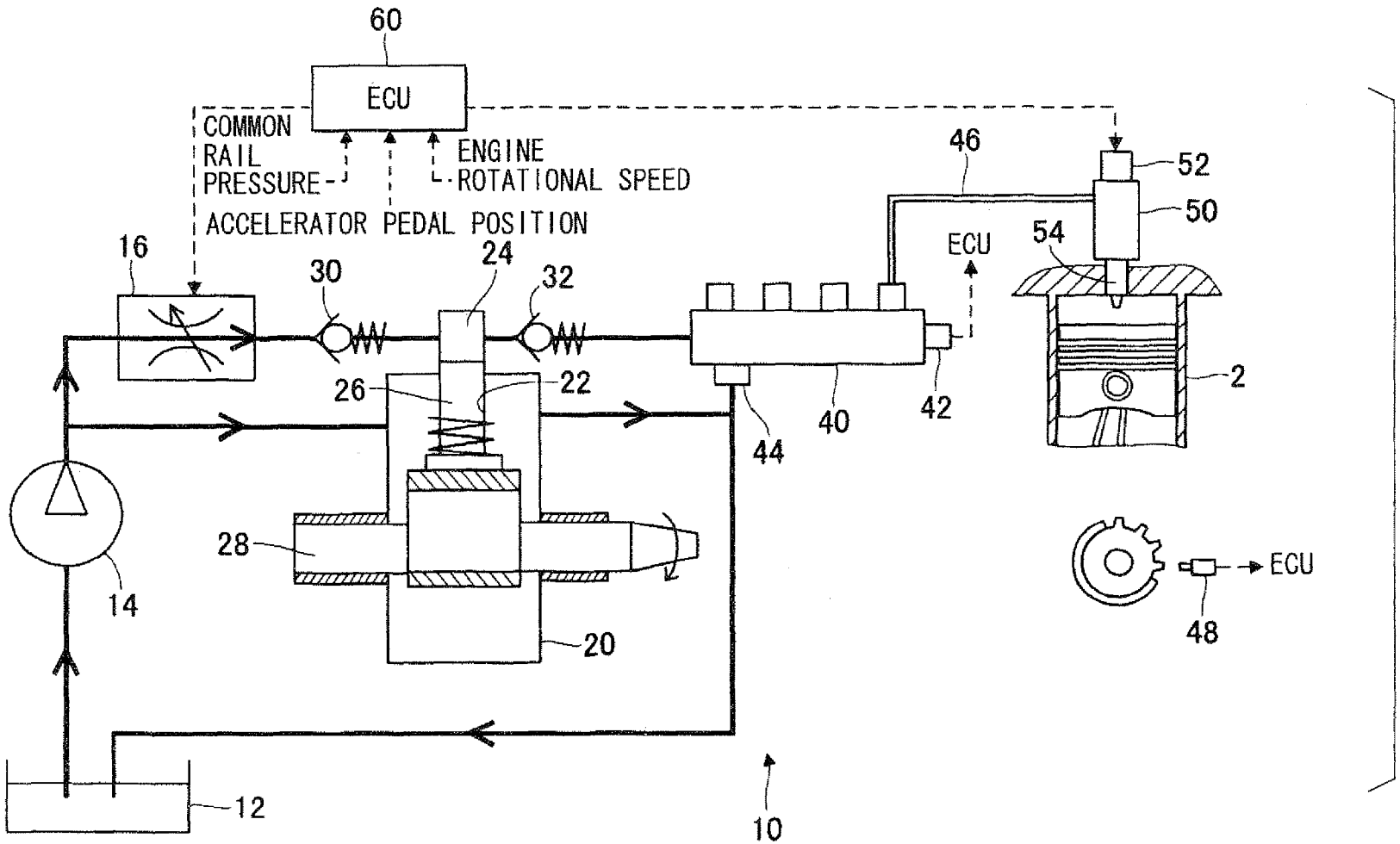
FIG. 1 is a block diagram illustrating a fuel injection system according to one embodiment of the present embodiment.

FIG. 1 shows a fuel injection system 10 according to the present embodiment. The fuel injection system 10 injects fuel to, for example, a four-cylinder diesel engine 2 (hereinafter referred as "engine") of a vehicle. The fuel injection system 10 includes a high-pressure pump 20, a common rail 40, a fuel injection valve 50, and an electronic control device (ECU: Electronic Control Unit) 60. The high-pressure pump 20 pressurizes fuel, and the common rail 40 accumulates high-pressure fuel fed by the high-pressure pump 20. The fuel injection valve 50 injects high-pressure fuel supplied by the common rail 40 into a combustion chamber of each cylinder of the engine 2. The ECU 60 controls the above system.

A feed pump 14 pumps fuel from a fuel tank 12 and discharges the fuel to the high-pressure pump 20. A metering valve 16 is provided on a suction side of the high-pressure pump 20 and is electrically controlled to adjust a suction amount of fuel suctioned into the high-pressure pump 20 during an intake stroke. Thus, the fuel suction amount is metered, and thereby the amount of fuel discharged by the high-pressure pump 20 is regulated.

The high-pressure pump 20 serves as a fuel supply pump and intakes fuel discharged by the feed pump 14 into a pressurizer chamber 24 within a cylinder 22 through an inlet valve 30. A plunger 26 is reciprocably displaced in accordance with rotation of a camshaft 28 and pressurizes the fuel in the pressurizer chamber 24. The fuel pressurized in the pressurizer chamber 24 is supplied to the common rail 40 through a discharge valve 32.

The common rail 40 receives high-pressure fuel supplied from the high-pressure pump 20 and accumulates the high-pressure fuel at a target rail pressure. A pressure sensor 42 detects a fuel pressure (referred as a common rail pressure) in the common rail 40 and outputs signals to the ECU 60. A pressure limiter 44 discharges fuel in the common rail 40 when the common rail pressure exceeds a predetermined upper limit value such that the common rail pressure is limited from further exceeding the upper limit value.

The fuel injection valve 50 is provided to each cylinder of the engine 2 and is connected with the common rail 40 through a high-pressure line 46. The fuel injection valve 50 includes a solenoid valve 52 and a nozzle 54. The solenoid valve 52 opens and closes a low-pressure passage (not shown) in order to control pressure in a control chamber, which is supplied with high-pressure fuel from the common rail 40. The low-pressure passage is communicated with a lower-pressure side of the control chamber. The solenoid valve 52 opens the low-pressure passage when the solenoid valve 52 is energized and closes the low-pressure passage when deenergized.

The nozzle 54 includes therein a needle (not shown) that opens and closes an injection orifice. The fuel pressure in the control chamber is applied to the needle in valve closing direction for closing the injection orifice. As a result, by energizing the solenoid valve 52, the low-pressure passage is opened, and thereby fuel pressure in the control chamber decreases. Thus, the needle is displaced in a valve opening direction opposite from the valve closing direction within the nozzle 54 such that the injection orifice is opened. As a result, high-pressure fuel supplied from the common rail 40 is injected through the injection orifice. In contrast, when the solenoid valve 52 is deenergized to close the low-pressure passage fuel pressure in the control chamber increases accordingly. Then, the needle is displaced downwardly in the valve closing direction within the nozzle 54 such that the injection orifice is closed. As a result, the injection is stopped.

The ECU 60 serving as a fuel injection controller includes a microcomputer that mainly has a CPU, a ROM, a RAM, a flash memory, and an input/output interface. The ECU 60 retrieves detection signals from various sensors, such as the pressure sensor 42, a rotational speed sensor 48, an accelerator pedal position sensor, in order to control an operational state of the engine. For example, the ECU 60 controls an amount of fuel suctioned by the high-pressure pump 20, and a fuel injection quantity and fuel injection timing of the fuel injection valve 50. Also, the ECU 60 controls a pattern of executing multi-stage injection including pilot injection, post injection, and main injection. For example, the pilot injection is made before the main injection with a minute injection quantity, and the post injection is made after the main injection in the multi-stage injection control. The ECU 60 outputs a drive signal for commanding the fuel injection valve 50 to inject fuel. The drive signal is a pulse signal, a pulse width of which is used for controlling the injection quantity. The commanded injection quantity increases with an increase of the pulse width of the pulse signal.

Figure 2:
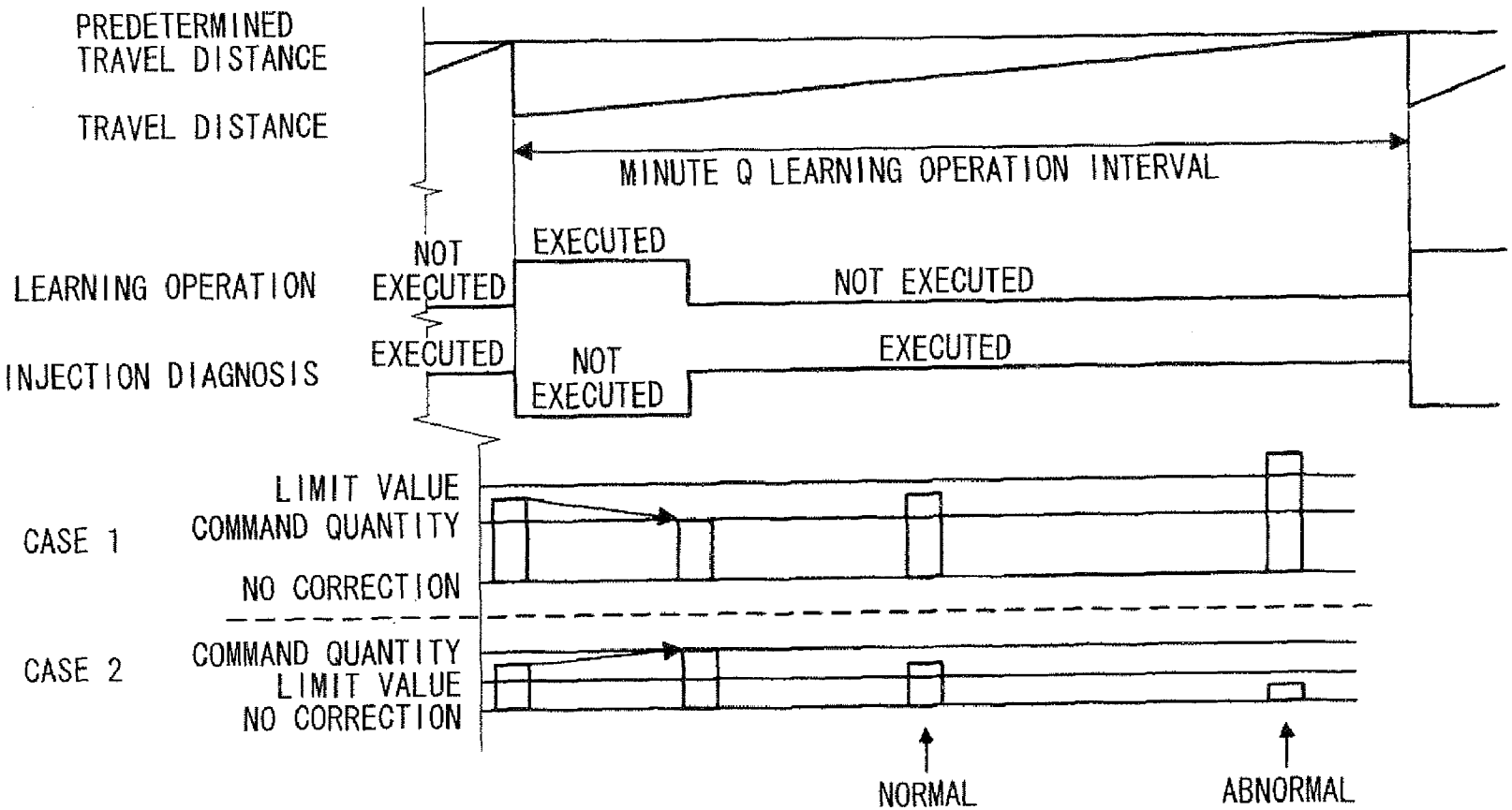
FIG. 2 is an explanatory diagram illustrating an injection quantity abnormality during a time period between period minute injection quantity learning operations.

In the fuel injection system 10, the ECU 60 executes the normal injection control of the fuel injection valve 50 as above. Also, the ECU 60 executes a minute injection quantity learning operation (minute Q learning operation) and an injection quantity diagnosis as shown in FIG. 2. The ECU 60 executes the minute injection quantity learning operation at every predetermined travel distance interval of, for example several hundreds km to several thousands km. The ECU 60 learns a correction pulse width of the pulse signal based on a difference between (a) an actual injection quantity and (b) the command injection quantity, which serves as a pilot injection quantity, using a similar method of a minute injection quantity learning operation shown in JP-A-2005-36788. For example, the correction pulse width of the pulse signal serves as a correction amount used for correcting the drive signal (referred as a learning correction amount) such that the actual injection quantity is corrected to become the command injection quantity.

In a case, where slide failure or wear of the fuel injection valve 50 occurs during a time period between a previous minute injection quantity learning operation and a next minute injection quantity learning operation, a deviation amount between the command injection quantity and the actual injection quantity of the fuel injection valve 50 may become greater. In the operation, the drive signal is corrected by the learning correction amount, which is learned during the previous minute injection quantity learning operation, and the corrected drive signal is used for commanding the fuel injection of the fuel injection valve 50. If the deviation amount between the command injection quantity and the actual injection quantity of the fuel injection valve 50 stays with in a predetermined injection quantity range, an amount of toxic substances discharged in the exhaust gas successfully stays within an allowable range accordingly.

However, in a case, where the slide failure or the wear of the fuel injection valve 50 occurs more severely than expected during the time period between the previous and next minute injection quantity learning operations, the actual injection quantity may become greater (or in another case, smaller) than the command injection quantity by a magnitude greater than a predetermined range even when the drive signal has been corrected by the learning correction amount. In the above case, because the minute injection quantity learning operation is only the way to detect the injection quantity abnormality, the above abnormality will not be detected until the next minute injection quantity learning operation.

Thus, in the present embodiment, the injection quantity diagnosis of the fuel injection valve 50 is executed during a time period, in which the minute injection quantity learning operation is not executed. The ECU 60 serves as the fuel injection controller that executes the injection quantity diagnosis of the fuel injection valve 50. More specifically, the ECU 60 functions as diagnosis condition determination means, pressure control means, injection command means, correction amount computation means, correction limit determination means, and injection deviation amount computation means based on control programs stored in the ROM or the flash memory.

(Diagnosis Condition Determination Means)

The ECU 60 serves as the diagnosis condition determination means for determining that a diagnosis condition for diagnosing the injection quantity of the fuel injection valve 50 is satisfied when an accelerator pedal is not pressed, and thereby the engine 2 is operated under a non-injection operational state, in which the speed is reduced and the injection is not made, at the time, in which the minute injection quantity learning operation is not executed. In other words, the ECU 60 determines that the diagnosis condition is satisfied when the engine 2 is operated under the non-injection operational state at the time, in which the minute Q learning operation is under a "not executed" state in FIG. 2. The ECU 60 determines whether the diagnosis condition for the injection quantity diagnosis is satisfied at least once in one operational period of the engine 2, in which the engine 2 is started and then stopped. Thus, if the diagnosis condition is satisfied during the operational period of the engine 2, it is possible to execute the injection quantity diagnosis at least once during the operational period of the engine 2.

Because the injection quantity diagnosis is executed in the above non-injection operational state, it is possible to highly accurately compute an injection deviation amount during an operational state that is less likely to be influenced by disturbance. The above injection deviation amount is defined as a difference between (a) the command injection quantity and (b) the actual injection quantity of fuel in a diagnostic injection performed based on the drive signal corrected by the correction limit value. For example, when the correction amount is equal to or less than the correction limit value, it is possible to accurately correct the injection quantity based on the correction amount such that the actual injection quantity substantially becomes the command injection quantity. However, when the correction amount is greater than the correction limit value, it may not be assured that the injection quantity is accurately corrected based on the correction amount. Because the correction amount may be a positive value or a negative value, the condition of that "the correction amount is equal to or less than the correction limit value" indicates that "the correction amount is equal to or less than the correction limit value (upper limit value or lower limit value) in absolute value".

(Pressure Control Means)

When the diagnosis condition is satisfied, the ECU 60 control the common rail pressure to a predetermined pressure in order to perform the diagnostic injection in order to diagnose the injection quantity of the fuel injection valve 50. More specifically, in order to control the common rail pressure, the ECU 60 controls the discharge amount of the high-pressure pump 20 or alternatively, the ECU 60 drains fuel in the control chamber of the fuel injection valve 50 to the lower-pressure side such that the pressure in the control chamber is reduced to a certain pressure, at which the fuel injection valve 50 is still limited from injecting fuel.

The common rail pressure is operated in an operational pressure range that ranges from a lower pressure to a higher pressure, and the operational pressure range of the common rail pressure is divided into multiple pressure sections. For example, in the minute injection quantity learning operation, the common rail pressure is controlled at each of the pressure sections such that the correction amount is learned. However, in the injection quantity diagnosis of the present embodiment, the common rail pressure is controlled only to a predetermined pressure section or only to two pressure sections of all the pressure sections when the diagnostic injection is executed. The two pressure sections include one section in the lower-pressure side and the other section in the higher-pressure side. The above is enabled in the present embodiment because it is only needed to determine the abnormality of the injection quantity and also to diagnose the level of the abnormality.

(Injection Command Means)

When the diagnosis condition is satisfied and the common rail pressure is adjusted to the predetermined pressure that is set for executing the diagnostic injection, the ECU 60 computes a command injection quantity of the fuel injected for the diagnostic injection, and the ECU 60 corrects a basic pulse width of the drive signal based on a correction amount. The correction amount includes a learning correction amount and a first pulse width correction amount as described later. The drive signal is used for injecting fuel having the command injection quantity. Then, the ECU 60 commands the fuel injection valve 50 to inject fuel for the diagnostic injection in the temporary diagnosis based on the corrected drive signal.

Then, as described later, when the injection quantity abnormality is detected as a result of the fuel injection in the temporary diagnosis, the ECU 60 commands the fuel injection valve 50 to inject fuel for a main diagnosis based on the drive signal corrected by a limited pulse width serving as the correction limit value or a limited value. The injection quantity abnormality is a state, where the correction amount obtained based on a difference between the actual injection quantity of the fuel injection valve 50 and the command injection quantity exceeds the correction limit value.

(Correction Amount Computation Means)

The ECU 60 serves as the correction amount computation means for computing generated torque of the engine 2 based on an amount of change in the rotational speed of the engine 2 changed when the fuel injection for the temporary diagnosis (temporary diagnosis injection) is performed. The generated torque of the engine 2 changes proportional to the injection quantity, and thereby it is possible to compute or estimate the actual injection quantity based on the generated torque. The ECU 60 computes a correction pulse width based on a difference between (a) the command injection quantity, based on which the fuel injection for the temporary diagnosis is commanded, and (b) the actual injection quantity. The above correction pulse width is used to correct the pulse width of the drive signal such that the actual injection quantity more substantially becomes the command injection quantity. When the actual injection quantity is smaller than the command injection quantity, the correction pulse width becomes a positive value in order to increase the pulse width of the drive signal and thereby to increase the injection quantity (see Case 2 in FIGS. 2, 3A, and 3B). In contrast, when the actual injection quantity is greater than the command injection quantity, the correction pulse width becomes a negative value in order to reduce the pulse width of the drive signal and thereby to reduce the injection quantity (see Case 1 in FIGS. 2, 3A, and 3B).

(Correction Limit Determination Means)

Figure 3A:
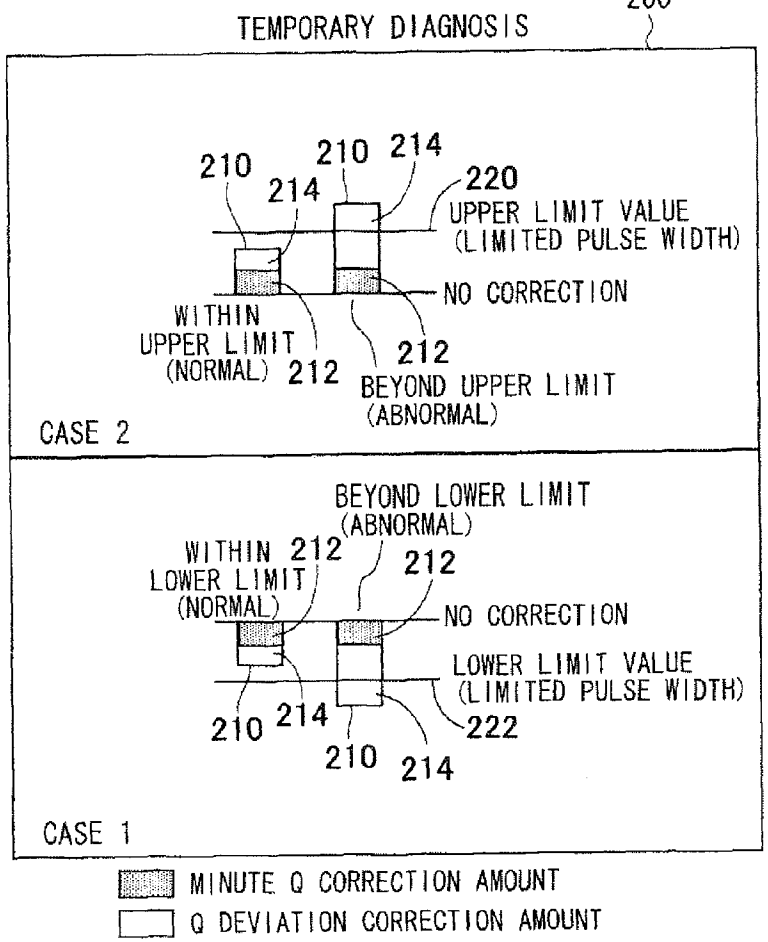
FIG. 3A is an explanatory diagram illustrating a temporary diagnosis for injection quantity diagnosis.
Figure 3B:
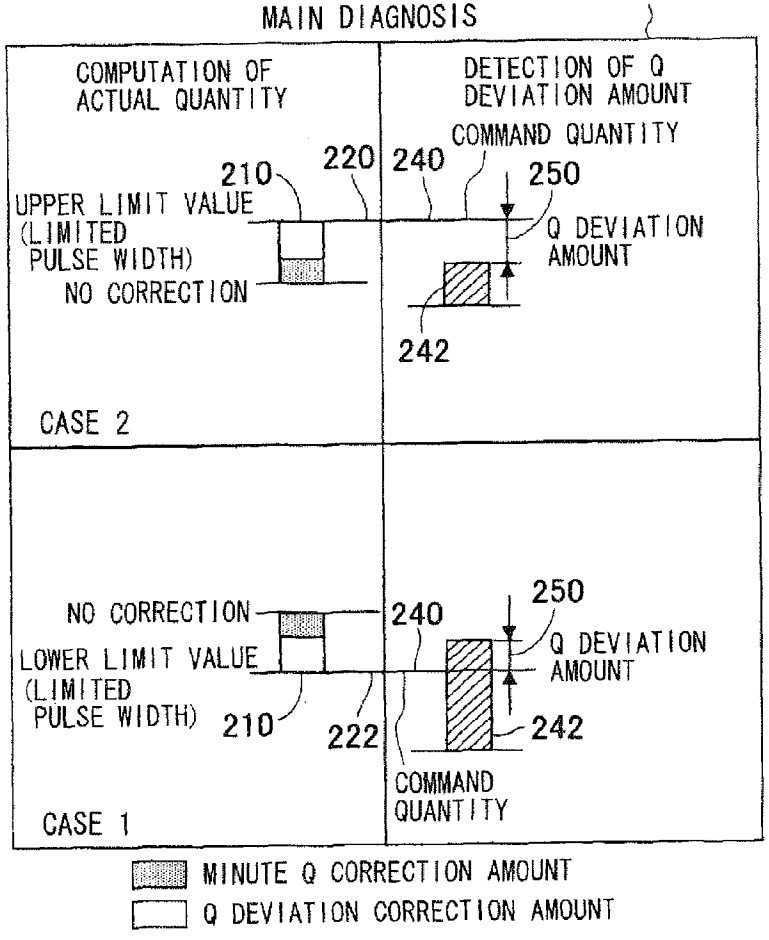
FIG. 3B is an explanatory diagram illustrating a main diagnosis for the injection quantity diagnosis.

The ECU 60 serves as the correction limit determination means for determining whether a correction pulse width 210 computed by the correction amount computation means exceeds a correction upper limit value 220 or a correction lower limit value 222 based on the result of the fuel injection for the temporary diagnosis as shown in a temporary diagnosis 200 of FIG. 3A. The correction upper limit value 220 and the correction lower limit value 222 serves as the above described correction limit value or serves as a guard value. In the temporary diagnosis 200, the correction pulse width 210 that is used for correcting the basic pulse width of the drive signal is a sum of a learning correction amount 212 and a correction amount 214 and serves as "the correction amount".

When the correction pulse width 210 exceeds the limited pulse width (the correction upper limit value 220 or the correction lower limit value 222), the ECU 60 determines that an injection quantity abnormality of the fuel injection valve 50 occurs. For example, in the injection quantity abnormality, the actual injection quantity deviates from the command injection quantity so much that the correction pulse width 210 that is equal to or less than the correction limit value may not appropriately work in the correction of the actual injection quantity any more.

(Injection Deviation Amount Computation Means)

The ECU 60 serves as the injection deviation amount computation means. When the correction pulse width 210 exceeds the limited pulse width 220 or 222, the ECU 60 commands the fuel injection valve 50 to inject fuel for the main diagnosis based on the drive signal that is made by correcting the basic pulse width of the drive signal to become the limited pulse width 220 or 222 that serves as the correction limit value as shown in the main diagnosis 230 of FIG. 3B. Then, a difference between (a) a command injection quantity 240 and (b) an actual injection quantity 242, which is injected by the fuel injection valve 50 based on the drive signal corrected by the limited pulse width 220, 222, is computed as an injection deviation amount 250. The injection deviation amount 250 corresponds to a Q deviation amount in FIG. 3B. In the above, the injection deviation amount 250 indicates an uncorrectable deviation amount made between the command injection quantity 240 and the actual injection quantity 242. The abnormality level of the injection quantity of the fuel injection valve 50 increases with an increase of the injection deviation amount 250.

(Injection Quantity Diagnosis)

Figure 4:
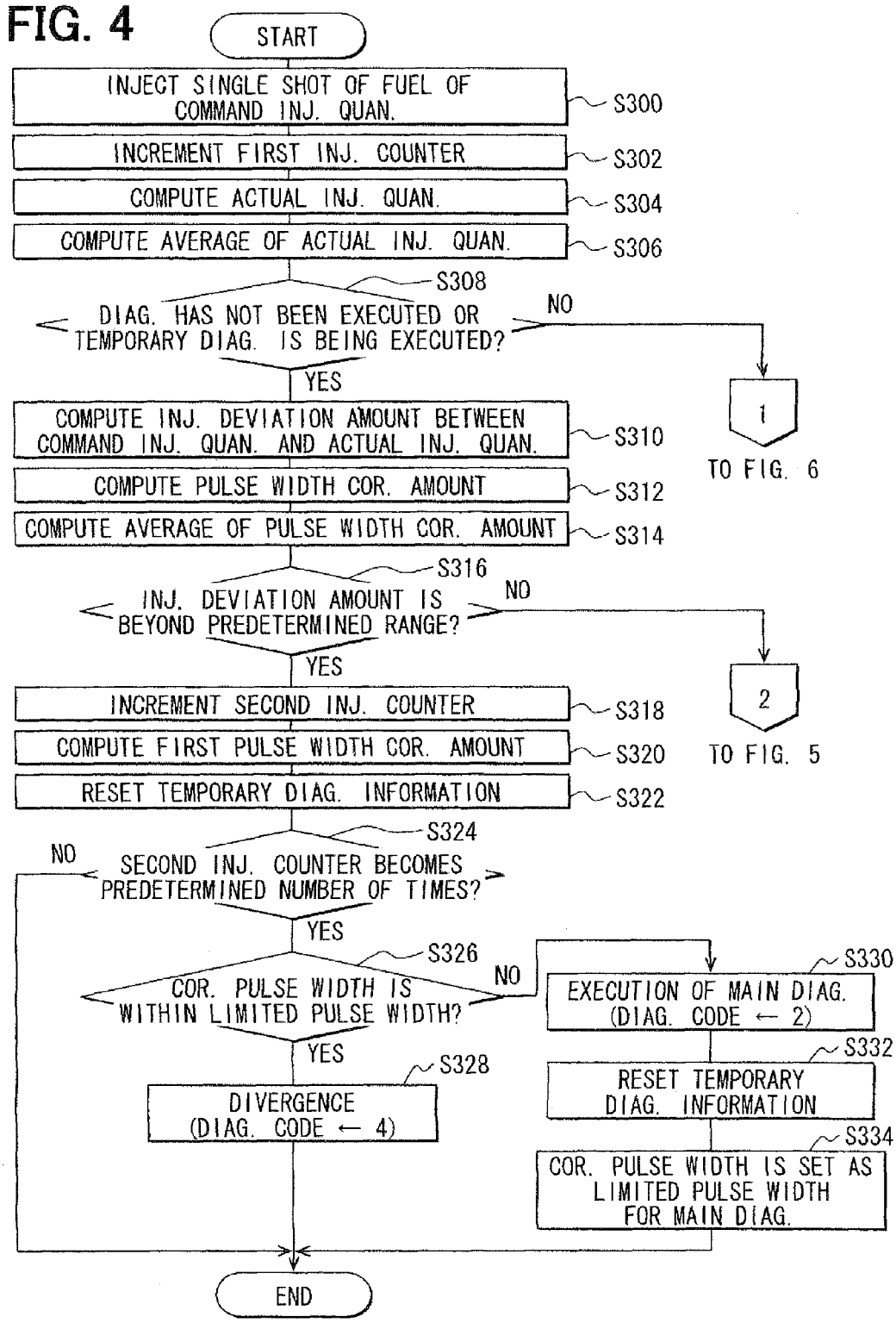
FIG. 4 is a flow chart illustrating the injection quantity diagnosis.
Figure 5:
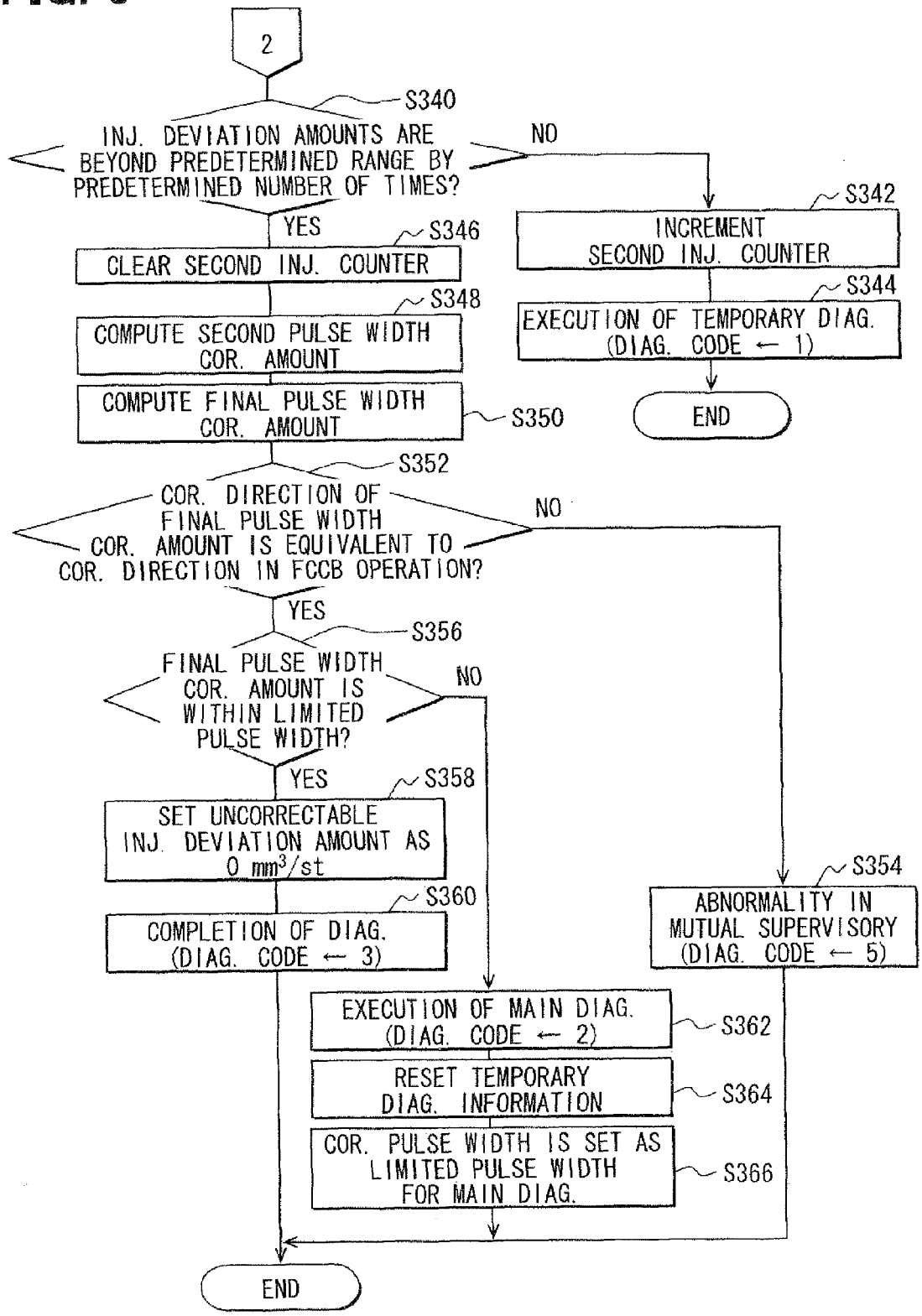
FIG. 5 is another flow chart continued from the flow chart of FIG. 4 for illustrating the injection quantity diagnosis.
Figure 6:
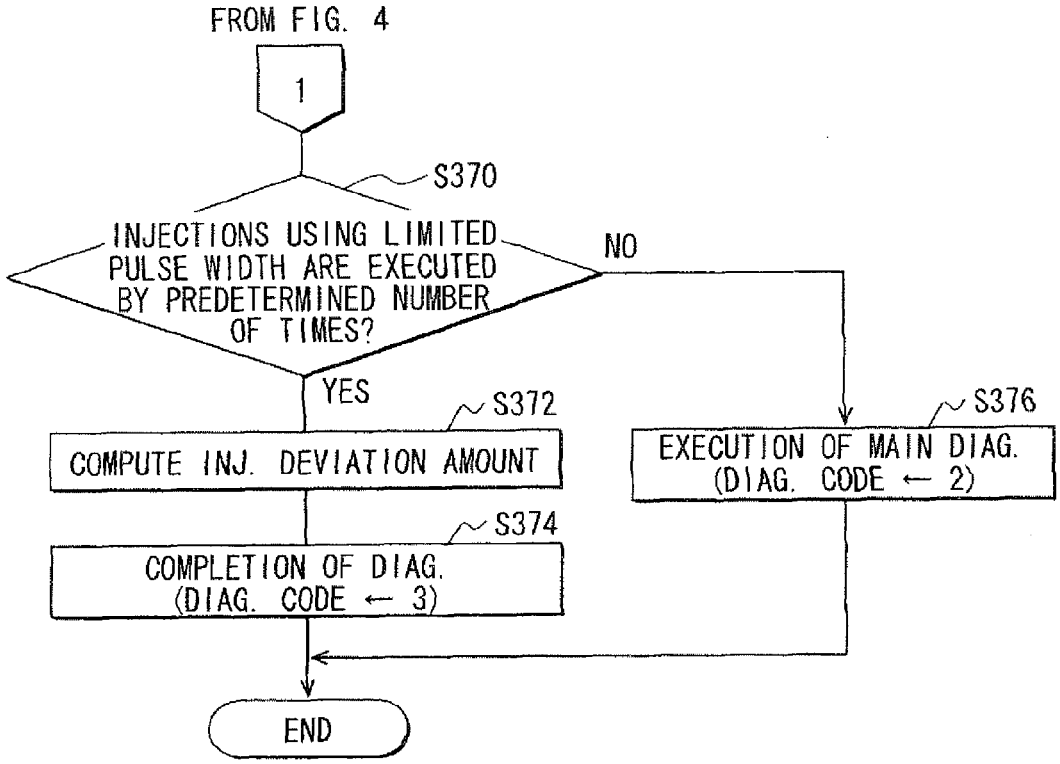
FIG. 6 is still another flow chart continued from the flow chart of FIG. 4 for illustrating the injection quantity diagnosis.

Next, the injection quantity diagnosis of diagnosing the fuel injection valve 50 will be described with reference to FIG. 4 to FIG. 7B. In flow charts shown in FIG. 4 to FIG. 6, "S" indicates step. When the diagnosis condition for executing the injection quantity diagnosis is satisfied, diagnostic routines shown in the flow charts of FIG. 4 to FIG. 6 are repeatedly executed until the injection quantity diagnosis for each cylinder at the predetermined common rail pressure is ended. In a case, where the injection quantity diagnosis is executed at the pressure sections including one section in the lower-pressure side and the other section in the higher-pressure side within the operational pressure range of the common rail pressure, the diagnostic routines shown in FIG. 4 to FIG. 6 are executed to each of the cylinders at the common rail pressure controlled to the one section in the lower-pressure side and the other section in the higher-pressure side.

In a routine for finally diagnosing the abnormality of the fuel injection valve 50, the abnormality of the injection quantity of the fuel injection valve 50 is diagnosed based on the result of the diagnostic routines shown in FIG. 4 to FIG. 6. A temporary diagnosis process includes steps at and after S310 in FIG. 4 and FIG. 5, and in the temporary diagnosis process, it is determined whether the deviation amount between the command injection quantity and the actual injection quantity of the fuel injection valve 50 is within a range, in which the deviation amount is correctable. FIG. 6 is a main diagnosis process for computing a deviation amount between the command injection quantity and the actual injection quantity when the correction pulse width is corrected to the correction limit value. S300 to S308 in FIG. 4 are a common process that is used in both the temporary diagnosis and the main diagnosis.

(Common Process)

At S300 of FIG. 4, the ECU 60 computes the command injection quantity for the diagnostic injection. Also, the ECU 60 corrects the basic pulse width of the drive signal based on the learning correction amount (pulse width), which is learned in the previous minute injection quantity learning operation, and based on a first pulse width correction amount (described later), which is computed in the temporary diagnosis. Then, the ECU 60 commands the fuel injection valve 50 to inject a single shot of fuel of the command injection quantity as the diagnostic injection. The command injection quantity computed at S300 is very small and corresponds to, for example, the pilot injection quantity during the multi-stage injection. The command injection quantity remains the constant value until the end of the below described temporary diagnosis and main diagnosis for the cylinder.

The first pulse width correction amount of the temporary diagnosis is a correction amount that is used for correcting the learning correction amount based on the difference between the command injection quantity and the actual injection quantity. The above learning correction amount is learned in the minute injection quantity learning operation such that the actual injection quantity becomes the command injection quantity. An initial value of the first pulse width correction amount is 0.

In the temporary diagnosis, the first pulse width correction amount may be set as any amount such that the sum of the first pulse width correction amount and the learning correction amount learned in the minute injection quantity learning operation may exceed the correction limit value, such as the positive upper limit value, the negative lower limit value. In contrast, in the main diagnosis, the first pulse width correction amount is set as a certain amount such that the sum of the first pulse width correction amount and the learning correction amount becomes the correction limit value, such as the positive upper limit value, the negative lower limit value.

At S302, the ECU 60 increments a first injection counter. At S304, the ECU 60 computes the generated torque based on the rotational speed change amount of the engine 2 as described above, and computes the actual injection quantity based on the generated torque. At S306, the ECU 60 divides the sum of the actual injection quantities that have been injected through the diagnostic injection so far by the value of the first injection counter in order to compute an average value of the actual injection quantities. At S308, the ECU 60 determines whether the diagnosis has not been executed or the temporary diagnosis is being executed based on a diagnostic code. An initial value of the diagnostic code is 0. Thus, when the diagnostic code is 0, the ECU 60 determines that the diagnosis has not been executed and also that the temporary diagnosis has not been executed yet either. Accordingly, the ECU 60 identifies the current temporary diagnosis as the first diagnostic injection. When the diagnostic code indicates 1, the ECU 60 determines that the temporary diagnosis is being executed, and thereby the ECU 60 identifies the current temporary diagnosis is the second diagnostic injection of the multiple temporary diagnosis in series. Also, when the diagnostic code is 2, the ECU 60 determines that the main diagnosis is being executed.

Values of the diagnostic code other than 0 to 2 indicate the result of the injection quantity diagnosis. The diagnostic code of 3 indicates completion of the diagnosis as shown in the following two cases. In one of the two cases, the diagnosis is determined as completed when the deviation amount between the command injection quantity and the actual injection quantity is within the correctable range, and thereby the uncorrectable deviation amount is 0 $mm^3$/st. In the other case, the diagnosis is also determined as completed if the uncorrectable deviation amount has been successfully computed even though the correction pulse width exceeds the correction limit value.

The diagnostic code of 4 indicates an abnormal divergence of the injection quantity. More specifically, in a case, where the abnormal divergence occurs, the actual injection quantity will not come close to the command injection quantity even when the drive signal is corrected in the temporary diagnosis, and eventually the injection quantity diverges abnormally.

The diagnostic code of 5 indicates the abnormality in a mutual supervisory system. More specifically, the abnormality in the mutual supervisory system means that a correction of the injection quantity in the temporary diagnosis is different from a correction of injection quantity in a fuel control for cylinder balancing operation (FCCB operation). For example, in the abnormality in the mutual supervisory system, the correction direction for increasing or decreasing the injection quantity of the cylinder of interest is different from a correction direction for increasing or decreasing the injection quantity of the cylinder of interest in the FCCB operation. When the FCCB operation is performed, the variation in torque due to the variation of the injection quantity among cylinders is detected based on the variation of the rotational speed corresponding to each cylinder, and the command injection quantity is corrected such that the variation in the rotational speed of each cylinder is equated with each other in magnitude.

When the diagnosis has not been executed or the temporary diagnosis is being executed (Yes at S308), the ECU 60 proceeds control to S310. When the main diagnosis is being executed (No at S308), the ECU 60 proceeds control to S370 in FIG. 6.

The ECU 60 may execute the temporary diagnosis and the main diagnosis in series to each cylinder. Alternatively, the ECU 60 may execute the temporary diagnosis to all cylinders first, and then the ECU 60 may execute the main diagnosis to all cylinders. Details will be described below.

(Temporary Diagnosis 1)

At S310, the ECU 60 computes the injection deviation amount that is the difference between the command injection quantity and the actual injection quantity of the fuel that is injected by the fuel injection valve 50 in the current diagnostic injection. Then, at S312, the ECU 60 computes the pulse width correction amount based on the injection deviation amount. The pulse width correction amount is computed in order to correct the pulse width of the drive signal such that the actual injection quantity becomes the command injection quantity. Also, at S314, the ECU 60 computes an average of the pulse width correction amounts that has been computed up to the current diagnosis injection during the temporary diagnosis. When the actual injection quantity is greater than the command injection quantity, and thereby the injection deviation amount is computed as a negative value, the pulse width correction amount becomes a negative value accordingly. The above computation is made in order to reduce the actual injection quantity by reducing the pulse width of the drive signal defined by the basic pulse width and the learning correction amount. In contrast, when the actual injection quantity is smaller than the command injection quantity, and thereby the injection deviation amount is computed as a positive value, the pulse width correction amount becomes a positive value in order to increase the actual injection quantity by increasing the pulse width of the drive signal.

At S316, the ECU 60 determines whether the injection deviation amount computed at S310 is beyond a predetermined range. In a case, where the ECU 60 determines at S316 that the multiple injection deviation amounts that are obtained in series are within the predetermined range (OK Region) as shown in FIG. 7A, the predetermined range used at S316 for the determination is reduced gradually. When the ECU 60 determines at S316 that the injection deviation amount becomes beyond the predetermined range (NG Region), the temporary diagnosis is ended at the step that follows S316 and started again from S300. This means re-executing of the temporary diagnosis as described later. At the time of re-executing the temporary diagnosis, the predetermined range is set as an initial value, and the data sets are reset at steps that follow S316.

When the injection deviation amount between the command injection quantity and current actual injection quantity exceeds the predetermined range (Yes at S316), the ECU 60 proceeds control to S318. When the injection deviation amount is within the predetermined range (No at S316), the ECU 60 proceeds control to S340 in FIG. 5.

At S318, the ECU 60 increments a second injection counter. In this way, the ECU 60 counts the number of times of the injection for the temporary diagnosis injection. The ECU 60 also counts the number of times of the injection performed in the re-execution of the temporary diagnosis. Then, further execution of the temporary diagnosis injection is prohibited when it is determined at S324 that the number of times of the injection counted by the second injection counter reaches a predetermined number of times as described later.

At S320, the first pulse width correction amount is set as the average of the pulse width correction amounts computed at S314. Then, at S322, the ECU 60 clears the number of times counted by the first injection counter, the average of the actual injection quantity computed at S306, the average of the pulse width correction amount computed at S314, and the diagnostic code to be zero (first reset of temporary diagnosis information). Also, as described above, the ECU 60 sets the predetermined range, which is used for the determination in S316, as the initial value. As above, the ECU 60 prepares the values of the variables in order to re-execute the temporary diagnosis injection from the beginning because it is determined at S316 that the injection deviation amount between the command injection quantity and the current actual injection quantity exceeds the predetermined range.

The ECU 60 determines at S324 whether the second injection counter becomes a predetermined number of times. When the second injection counter becomes the predetermined number of times (Yes at S324), the ECU 60 determines that the temporary diagnosis injection is executed in series by the predetermined number of times. The total number of times of executing the temporary diagnosis injection includes the number of times of re-executing of the temporary diagnosis. In the above case, the ECU 60 prohibits the further execution of the temporary diagnosis injection to the cylinder of interest. Then, control proceeds to S326, where the ECU 60 determines whether the sum of the learning correction amount 212 (minute Q correction amount in FIG. 3A) and the first pulse width correction amount 214 (Q deviation correction amount in FIG. 3A) is equal to or less than the limited pulse width as shown in FIG. 3A. For example, when the sum of the correction amounts 212, 214 is equal to or less than the limited pulse width, the drive signal is appropriately correctable by the sum of the correction amounts 212, 214.

The ECU 60 determines that the actual injection quantity will not converge to the command injection quantity but rather diverges abnormally when the following three conditions are satisfied. The three conditions are as follows. (1) The injection deviation amount between the command injection quantity and the current actual injection quantity exceeds the predetermined range (Yes at S316). (2) The number of times counted by the second injection counter becomes the predetermined number of times (Yes at S324). (3) The sum of the first pulse width correction amount and the learning correction amount is within the limited pulse width (Yes at S326). Then, the ECU 60 sets the diagnostic code as 4 that corresponds to divergence (see FIG. 7B) and ends the present routine at S328. When it is determined at S308 that the diagnostic code is 4, the ECU 60 is restricted from executing the main diagnosis to the cylinder of interest and executes the temporary diagnosis to the other cylinder that has not been executed with the temporary diagnosis if there is any such cylinder.

When the first pulse width correction amount corresponds to a width such that the sum of the first pulse width correction amount and the learning correction amount exceeds the limited pulse width (No at S326), the ECU 60 determines that it is impossible to correct the injection deviation amount to become within the predetermined range if the correction pulse width is equal to or less than the limited pulse width. Then, control proceeds to S330, where the ECU 60 sets the diagnostic code as 2 indicating execution of the main diagnosis (see a second line from the bottom in a chart of FIG. 7B) in order to execute the main diagnosis for computing an uncorrectable injection deviation amount. When the diagnostic code is set as 2, the determination at S308 corresponds to "No", and thereby the main diagnosis is executed.

Control proceeds to S332, where the ECU 60 clears the value of the first injection counter and the average value of the actual injection quantities computed at S306. Then, control proceeds to S334, where the ECU 60 sets the first pulse width correction amount as a certain amount such that the sum of the first pulse width correction amount and the learning correction amount becomes the limited pulse width (the positive correction upper limit value or the negative correction lower limit value). Then, the ECU 60 ends the present routine.

(Temporary Diagnosis 2)

When it is determined at S316 that the injection deviation amount between the command injection quantity and the current actual injection quantity is within the predetermined range (No at S316), control proceeds to S340 of FIG. 5, where the ECU 60 determines whether each of the injection deviation amounts that are obtained in series by the predetermined number of times during the temporary diagnosis is within the predetermined range.

When it is determined that each of the injection deviation amounts that are obtained in series by the predetermined number of times is beyond the predetermined range (No at S340), the ECU 60 increments the second injection counter at S342. Then, control proceeds to S344, where the ECU 60 sets the diagnostic code as 1 that indicates execution of the temporary diagnosis Then, the ECU 60 ends the present routine.

When it is determined that each of the injection deviation amounts that are obtained in series by the predetermined number of times is within the predetermined range (Yes at S340), control proceeds to S346, where the ECU 60 clears the second injection counter. Then, control proceeds to S348, where the ECU 60 computes the second pulse width correction amount that is a pulse width correction amount used for further correcting the basic pulse width of the drive signal that is corrected by the learning correction amount and the first pulse width correction amount in order to further reduce the deviation amount between the command injection quantity and the actual injection quantity. More specifically, the sum of the learning correction amount, the first pulse width correction amount, and the second pulse width correction amount is used to correct the basic pulse width of the drive signal in order to further reduce the deviation amount.

Then, control proceeds to S350, where the ECU 60 computes a final pulse width correction amount by summing the learning correction amount, the first pulse width correction amount, and the second pulse width correction amount computed at S348. Then, it is determined whether a correction direction for increasing or decreasing the injection quantity of the cylinder of interest using the final pulse width correction amount is equivalent to a correction direction for increasing or decreasing the injection quantity of the cylinder of interest in the FCCB operation.

When the correction directions are not equivalent with each other (No at S352), control proceeds to S354, where the ECU 60 sets the diagnostic code as 5 (see second and fourth lines in the chart in FIG. 7B) in order to indicate abnormality in the mutual supervisory system, and the ECU 60 ends the present routine. The abnormality in the mutual supervisory system is a situation, where the correction direction in the FCCB operation is different from the correction direction in the injection quantity diagnosis.

When the correction directions are equivalent with each other (Yes at S352), control proceeds to S356, where the ECU 60 determines whether the final pulse width correction amount corresponds to a width within the limited pulse width. When it is determined that the final pulse width correction amount is within the limited pulse width (Yes at S356), the ECU 60 determines that the correction of the injection quantity based on the final pulse width correction amount is capable of making the actual injection quantity to become the command injection quantity. Then, control proceeds to S358, where the ECU 60 sets the uncorrectable injection deviation amount as 0 $mm^3$/st, and the ECU 60 sets the diagnostic code as 3 that corresponds to the completion of the diagnosis (see the first line from the top in the chart in FIG. 7B) at S360. Then, the ECU 60 ends the present routine. In the above case, because the injection quantity of the fuel injection valve 50 is normal, the ECU 60 is prevented from executing the main diagnosis to the cylinder of interest of the fuel injection valve 50.

When the final pulse width correction amount is beyond the limited pulse width (No at S356), the ECU 60 determines that a main diagnosis is needed. Thus, control proceeds to S362, where the ECU 60 sets the diagnostic code as 2 that corresponds to the executing of the main diagnosis (see third line from the top in the chart in FIG. 7B). Then, control proceeds to S364, where the ECU 60 clears the first injection counter and the average value of the actual injection quantities computed at S306 of FIG. 4. Then, control proceeds to S366, where the ECU 60 sets the first pulse width correction amount as a certain pulse width such that the sum of the first pulse width correction amount and the learning correction amount becomes the limited pulse width. In the above, the sum of the correction amounts 212, 214 corresponds to the correction pulse width 210, and the ECU 60 sets the correction pulse width 210 as the correction limit value 220 or 222. Then, the ECU 60 ends the present routine.

(Main Diagnosis)

The below description of the main diagnosis shows a routine after the diagnosis code has been set as 2, for example, at S330 or S362. At S300 of FIG. 4, the fuel injection valve 50 is commanded to inject fuel based on the drive signal that is corrected to the limited pulse width, and the actual injection quantity is computed at S304. Then, an average value of the actual injection quantities is computed as S306. Then, control proceeds to S308, where it is determined that the diagnostic code is 2 that corresponds to the execution of the main diagnosis. This means that the current state is not "non-execution of the diagnosis" and is not "the execution of the temporary diagnosis" (No at S308). Then, control proceeds to S370 of FIG. 6, where the ECU 60 determines whether the main diagnosis injections based on the drive signal corrected by the limited pulse width are executed by the predetermined number of times. When it is determined that the main diagnosis injection is executed by the predetermined number of times (Yes at S370), the ECU 60 computes the injection deviation amount at S372. The injection deviation amount corresponds to a difference between the command injection quantity and the average value of the actual injection quantities computed at S306 of FIG. 4 during the main diagnosis. Thus, the computed injection deviation amount serves as the uncorrectable deviation amount. Then, the ECU 60 sets the diagnostic code as 3 that corresponds to the completion of the diagnosis, and ends the present routine at S374.

When it is determined that the number of times for executing the main diagnosis injection is less than the predetermined number of times (No at S370), the ECU 60 sets the diagnostic code as 2 at S376, and ends the present routine.

Injection quantity diagnosis means of the ECU 60 or the other ECU executes a final injection quantity diagnosis for the fuel injection valve 50 of each of the cylinders based on the diagnostic code that is obtained after the temporary diagnosis and the main diagnosis are executed. The Injection quantity diagnosis means executes the final injection quantity diagnosis also based on the diagnostic code and the value of the injection deviation amount when the diagnostic code is set as 3.

In the above present embodiment, by diagnosing the injection quantity of the fuel injection valve 50 during a time period between the minute injection quantity learning operations, the injection quantity abnormality during the above time period is detected.

Also, because the actual injection quantity is computed through the diagnostic injection based on the drive signal corrected to the limited pulse width in the main diagnosis of the present embodiment, the uncorrectable deviation amount between the command injection quantity and the actual injection quantity is highly accurately computed.

It is also possible to estimate an actual injection quantity of the limited pulse width based on the drive signal corrected by the correction pulse width that exceeds limited pulse width in the temporary diagnosis when the correction pulse width for the drive signal exceeds the limited pulse width However, the actual injection quantity is only estimated based on the correction pulse width and is not computed through the actual injection of fuel. Thus, the above estimation provides an actual injection quantity that has lower accuracy compared with the actual injection quantity of the present embodiment that is computed by injecting fuel for diagnostic injection based on the drive signal corrected by the limited pulse width.

Also, the injection quantity diagnosis is only required to detect at least the abnormality of the injection quantity and the injection deviation amount at the time of occurrence of the injection quantity abnormality. Therefore, the diagnostic injection is executed when the common rail pressure is at the predetermined one of the multiple pressure sections of the operational pressure range, at which the common rail is operated. Alternatively, the diagnostic injection may be executed twice respectively when the common rail pressure is at the lower-pressure side pressure section and the higher-pressure side pressure section. Thus, the injection quantity required for the diagnosis is reduced compared with a case of the minute injection quantity learning operation, where learning injection is executed for all of the multiple pressure sections of the operational pressure range for the common rail pressure.

In the diagnosing the injection quantity of the fuel injection valve 5 according to the present embodiment, firstly it is determined that whether a diagnosis condition for diagnosing the injection quantity of the fuel injection valve 5 is satisfied. At S300, the ECU 60 computes the drive signal that corresponds to the command injection quantity of fuel used in order to diagnose the injection quantity of the fuel injection valve 5. Then, the ECU 60 corrects the drive signal based on a first correction amount that corresponds to the correction pulse width 210 at S300. At S300, the ECU 60 also commands the fuel injection valve 5 to inject fuel based on the drive signal corrected by the first correction amount 210 when the diagnosis condition is satisfied. At S304, the ECU 60 computes a first actual injection quantity of fuel, which is actually injected by the fuel injection valve 5 based on the drive signal corrected by the first correction amount 210. At S320, the ECU 60 computes another correction pulse width 210 (second correction amount) based on a difference between the command injection quantity and the first actual injection quantity. At S326, the ECU 60 determines whether the second correction amount 210 exceeds a limit value 220, 222. At S300, the ECU 60 commands the fuel injection valve 5 to inject fuel based on the drive signal corrected by the limit value 220, 222 when the second correction amount 210 exceeds the limit value 220, 222. At S304, the ECU 60 computes a second actual injection quantity of fuel, which is actually injected by the fuel injection valve 5 based on the drive signal corrected by the limited value 220, 222. At S372, the ECU 60 computes an injection deviation amount between the command injection quantity and the second actual injection quantity of fuel. As a result, the uncorrectable injection deviation amount is highly accurately detected, and thereby the above advantages of the present embodiment are achieved.

[Other Embodiment]

In the above embodiment, when it is determined at S352 of FIG. 5 that the correction direction for increasing or decreasing the injection quantity of the cylinder of interest based on the final pulse width correction amount is equivalent with the correction direction for increasing or decreasing the injection quantity of the cylinder of interest in the FCCB operation (Yes at S352), the final pulse width correction amount computed at S350 is an appropriate correction amount regardless of whether the final pulse width correction amount is within the limited pulse width.

In a case, where it is determined at S352 that the correction directions are equivalent with each other (Yes at S352), the final pulse width correction amount computed at S350 may be set as the learning correction amount for the cylinder of interest at the common rail pressure, at which the injection quantity diagnosis is executed, when the final pulse width correction amount is within the limited pulse width (Yes at S356). When the final pulse width correction amount is beyond the limited pulse width (No at S356), the limited pulse width may be set as the learning correction amount for the cylinder of interest at the common rail pressure, at which the injection quantity diagnosis is executed.

In the above embodiment, the ECU 60 realizes functions of the diagnosis condition determination means, the injection command means, the actual injection quantity computation means, the correction amount computation means, the correction limit determination means, and the injection deviation amount computation means based on the control programs that specify the functions of the ECU 60. In contrast, a hardware, which has a specific function based on a circuit configuration of the hardware, may alternatively realize at least one of the above functions realized by the ECU 60.

As above, the present invention is not limited to the above embodiments, and the present invention is applicable to various embodiments provided that the various embodiments do not deviate from the gist of the present invention.

Functions of multiple means in the present invention is achievable by a hardware assembly having a specific function based on its configuration, by another hardware assembly having a specific function defined by a program, or by a combination of the above hardware assemblies. Also, the functions of multiple means are not limited to those that are achievable by physically-independent hardware assemblies.

Additional advantages and modifications will readily occur to those skilled in the art. The invention in its broader terms is therefore not limited to the specific details, representative apparatus, and illustrative examples shown and described.

What is claimed is:

1. A fuel injection controller for a fuel injection system that executes an injection quantity learning operation for a fuel injection valve that injects fuel into a cylinder of an internal combustion engine, wherein the fuel injection controller diagnoses an injection quantity of the fuel injection valve, the fuel injection controller comprising:

diagnosis condition determination means for determining whether a diagnosis condition for diagnosing the injection quantity of the fuel injection valve is satisfied;

injection command means for outputting a drive signal in order to command the fuel injection valve to inject fuel of a command injection quantity used in order to diagnose the injection quantity when the diagnosis condition is satisfied;

actual injection quantity computation means for computing an actual injection quantity of fuel that is actually injected by the fuel injection valve, which is commanded to inject fuel in order to diagnose the injection quantity;

correction amount computation means for computing a correction amount based on a difference between the actual injection quantity and the command injection quantity, the correction amount being used for correcting the drive signal;

correction limit determination means for determining whether the correction amount exceeds a limit value which serves as a threshold value that enables accurate correction of the actual injection quantity;

injection deviation amount computation means for computing an injection deviation amount between the command injection quantity and the actual injection quantity of fuel, which is injected by the fuel injection valve based on the drive signal that is corrected by the limit value, when the correction limit determination means determines that the correction amount exceeds the limit value; and injection quantity diagnose means for diagnosing abnormality of the injection quantity based on the injection deviation amount computed by the injection deviation amount computation means.

2. The fuel injection controller according to claim 1, wherein:

the drive signal is a pulse signal, a pulse width of which is used for controlling the injection quantity of the fuel injection valve;

the limit value corresponds to a limited pulse width of the pulse signal;

the pulse signal of the drive signal has a basic pulse width that corresponds to the command injection quantity; and the basic pulse width of the pulse signal of the drive signal is corrected by the limited pulse width such that the drive signal is corrected by the limited value.

3. The fuel injection controller according to claim 1, wherein:

the diagnosis condition determination means determines whether the diagnosis condition is satisfied at least once in one operational cycle of the engine, in which the engine starts and then stops.

4. The fuel injection controller according to claim 1, wherein:

the diagnosis condition determination means determines whether the diagnosis condition is satisfied based on whether the engine is operated in a non-injection operational state, in which a speed of the engine is reduced and fuel is not injected.

5. A method for diagnosing an injection quantity of a fuel injection valve comprising:

determining whether a diagnosis condition for diagnosing the injection quantity of the fuel injection valve is satisfied;

computing a drive signal that corresponds to a command injection quantity of fuel used in order to diagnose the injection quantity of the fuel injection valve;

correcting the drive signal based on a first correction amount;

commanding the fuel injection valve to inject fuel based on the drive signal corrected by the first correction amount when the diagnosis condition is satisfied;

computing a first actual injection quantity of fuel, which is actually injected by the fuel injection valve based on the drive signal corrected by the first correction amount;

computing a second correction amount based on a difference between the command injection quantity and the first actual injection quantity;

determining whether the second correction amount exceeds a limit value which serves as a threshold value that enables accurate correction of the actual injection quantity;

commanding the fuel injection valve to inject fuel based on the drive. signal corrected by the limit value when the second correction amount exceeds the limit value;

computing a second actual injection quantity of fuel, which is actually injected by the fuel injection valve based on the drive signal corrected by the limited value;

computing an injection deviation amount between the command injection quantity and the second actual injection quantity of fuel; and diagnosing abnormality of the injection quantity based on the injection deviation amount computed in said computing the injection deviation amount between (i) the command injection quantity and (ii) the second actual injection quantity of fuel which is actually injected by the fuel injection valve based on the drive signal corrected by the limited value.

6. The method according to claim 5, wherein:

the determining of whether the diagnosis condition is satisfied is performed at least once in one operational cycle of the engine, in which the engine starts and then stops.

7. The method according to claim 5, further comprising:

diagnosing the injection quantity of the fuel injection valve based on the injection deviation amount between the command injection quantity and the second actual injection quantity of fuel.

* * * * *